US011987856B2

(12) United States Patent
Tian et al.

(10) Patent No.: US 11,987,856 B2
(45) Date of Patent: *May 21, 2024

(54) ULTRA-HIGH STRENGTH MARAGING STAINLESS STEEL WITH SALT-WATER CORROSION RESISTANCE

(71) Applicants: The Boeing Company, Arlington, VA (US); Institute of Metal Research, Liaoning (CN)

(72) Inventors: Jialong Tian, Shenyang (CN); Ke Yang, Shenyang (CN); Wei Wang, Shenyang (CN); Yiyin Shan, Shenyang (CN); Wei Yan, Shenyang (CN)

(73) Assignees: The Boeing Company, Arlington, VA (US); Institute of Metal Research, Shenyang (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/312,769

(22) Filed: May 5, 2023

(65) Prior Publication Data

US 2023/0272497 A1 Aug. 31, 2023

Related U.S. Application Data

(60) Division of application No. 17/345,180, filed on Jun. 11, 2021, now Pat. No. 11,680,301, which is a (Continued)

(30) Foreign Application Priority Data

Jul. 26, 2016 (CN) ..... 201610592044.7

(51) Int. Cl.
*C21D 7/13* (2006.01)
*C21D 6/00* (2006.01)
(Continued)

(52) U.S. Cl.
CPC ..... *C21D 7/13* (2013.01); *C21D 6/004* (2013.01); *C21D 6/005* (2013.01); *C21D 6/007* (2013.01);
(Continued)

(58) Field of Classification Search
None
See application file for complete search history.

(56) References Cited

U.S. PATENT DOCUMENTS 6,475,307 B1 11/2002 Nystrom et al.
11,085,093 B2 * 8/2021 Tian ..... C21D 6/008
(Continued)

FOREIGN PATENT DOCUMENTS

| | | |
|---|---|---|
| CN | 101994066 | 3/2011 |
| CN | 103820729 | 5/2014 |
| WO | WO 2014/008564 | 1/2014 |

OTHER PUBLICATIONS

Hou H. et al: "Effect of Heat Treatment Temperature on the Mechanical Properties of Low-Temperature High Strength Maraging Steel." Materials Science and Engineering: A. 2014, vol. 601, pp. 1-6.

*Primary Examiner* — Brian D Walck
(74) *Attorney, Agent, or Firm* — Walters & Wasylyna LLC

(57) ABSTRACT

An ultra-high strength maraging stainless steel with nominal composition (in mass) of C≤0.03%, Cr: 13.0-14.0%, Ni: 5.5-7.0%, Co: 5.5-7.5%, Mo: 3.0-5.0%, Ti: 1.9-2.5%, Si: ≤0.1%, Mn: ≤0.1%, P: ≤0.01%, S: ≤0.01%, and Fe: balance. The developed ultra-high strength maraging stainless steel combines ultra-high strength (with σb≥2000 MPa, σ0.2≥1700 MPa, δ≥8% and ψ≥40%), high toughness (KIC≥83 MPa·m1/2) and superior salt-water corrosion resistance (with pitting potential Epit≥0.15 (vs SCE)). Therefore,
(Continued)

this steel is suitable to make structural parts that are used in harsh corrosive environments like marine environment containing chloride ions, etc.

20 Claims, 10 Drawing Sheets

Related U.S. Application Data continuation of application No. 16/315,475, filed as application No. PCT/US2017/040660 on Jul. 5, 2017, now Pat. No. 11,085,093.

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/50*** | (2006.01) |
| ***C22C 38/52*** | (2006.01) |

(52) U.S. Cl.

CPC ..... *C21D 6/008* (2013.01); *C22C 38/002* (2013.01); *C22C 38/02* (2013.01); *C22C 38/04* (2013.01); *C22C 38/44* (2013.01); *C22C 38/50* (2013.01); *C22C 38/52* (2013.01); *C21D 2211/001* (2013.01); *C21D 2211/008* (2013.01)

(56) References Cited

U.S. PATENT DOCUMENTS

| | | | | |
|---|---|---|---|---|
| 11,680,301 | B2 * | 6/2023 | Tian | C22C 38/50 148/578 |
| 2012/0080124 | A1 | 4/2012 | Barrow et al. | |

* cited by examiner

ULTRA-HIGH STRENGTH MARAGING STAINLESS STEEL WITH SALT-WATER CORROSION RESISTANCE

PRIORITY

This application is a divisional of U.S. Ser. No. 17/345,180 filed on Jun. 11, 2021, which is a continuation of U.S. Ser. No. 16/315,475 filed on Jan. 4, 2019, which is the U.S. national stage entry of Intl. App. No. PCT/US2017/040660 filed Jul. 5, 2017, which claims priority from Chinese Pat. App. No. 201610592044.7 filed on Jul. 26, 2016. The entire contents of U.S. Ser. No. 17/345,180, U.S. Ser. No. 16/315,475, Intl. App. No. PCT/US2017/040660 and Chinese Pat. App. No. 201610592044.7 are incorporated herein by reference.

FIELD

This application relates to high strength stainless steel and, more particularly, to ultra-high strength maraging stainless steel with salt-water corrosion resistance. The disclosed maraging stainless steel may be suitable for manufacturing structural parts intended for use in harsh corrosive environments, such as salt-water and the like, in which chloride ions are present.

BACKGROUND

Because of its corrosion resistance, stainless steel is widely used in machinery, the nuclear industry, aerospace, the building industry, and in various other civilian and military applications. The economic and technological status of stainless steel is significant. With the development of science and technology, and progress of human civilization, optimization and improvement in the comprehensive performance of stainless steel has become an inevitable trend.

The compositions and mechanical properties of various traditional stainless steels are presented in Tables 1 and 2.

TABLE 1

Nominal compositions of ultra-high strength (stainless) steels (wt %)

| Trademark | C | Cr | Ni | Co | Mo | Ti | Mn | Others |
|---|---|---|---|---|---|---|---|---|
| 300M | 0.4 | 0.8 | 1.8 | — | 0.4 | — | 0.8 | Si (1.6)<br>V (0.05) |
| Custom475 | <0.01 | 11.0 | 8.0 | 8.5 | 5.0 | — | <0.5 | Al (1.0-1.5) |
| 17-4PH | <0.07 | 17.0 | 4.0 | — | — | — | <1.0 | Si (<1.0 = Cu (4.0) |
| PH13-8Mo | <0.05 | 13.0 | 8.0 | — | 2.0 | — | <0.1 | Al (0.90-1.35) |
| 00Cr13Ni7Co5Mo4W | <0.01 | 13.6 | 7.3 | 4.9 | 4.3 | — | — | W (2.0) |
| CM400 | <0.01 | — | 17.7 | 14.7 | 6.7 | 1.2 | — | — |

TABLE 2

Mechanical properties and corrosion behaviors of ultra-high strength steels

| Trademark | Tensile strength (MPa) | Yield strength (MPa) | Elongation (%) | Stainless or not |
|---|---|---|---|---|
| 300M | 1995 | 1586 | 10.0 | no |
| Custom475 | 2006 | 1972 | 5.0 | yes |
| 17-4PH | 1399 | 1275 | 11.0 | yes |
| PH13-8Mo | 1551 | 1448 | 12.0 | yes |
| 00Cr13Ni7Co5Mo4W | 1550 | 1430 | 9.3 | yes |
| CM400 | 2760 | 2650 | 7.0 | no |

To meet application requirements for structural members, a core route for stainless steel optimization is to improve the mechanical properties while not jeopardizing corrosion resistance. Traditional high strength stainless steels, such as PH13-8Mo, 15-5PH and the like, have good corrosion resistance but low strength and, therefore, cannot meet the requirements for structural members. For example, Custom475 has tensile strength that reaches 2000 MPa, but its ductility is poor (elongation is about 5%), which severely limits its application. Some ultra-high strength steels (with strength over 1600 MPa) have the strength and toughness to meet the design requirements for structural members, but show poor corrosion resistance.

Accordingly, those skilled in the art continue with research and development efforts in the field of maraging stainless steel.

SUMMARY

In one embodiment, the disclosed maraging stainless steel has the following nominal composition: carbon (C): ≤0.03 wt %; chromium (Cr): 13.0-14.0 wt %; nickel (Ni): 5.5-7.0 wt %; cobalt (Co): 5.5-7.5 wt %; molybdenum (Mo): 3.0-5.0 wt %; titanium (Ti): 1.9-2.5 wt %; silicon (Si): ≤0.1 wt %; manganese (Mn): ≤0.1 wt %; phosphorus (P): ≤0.01 wt %; sulfur (S): ≤0.01 wt %; and iron (Fe): balance.

In another embodiment, the disclosed maraging stainless steel has the following nominal composition: C: ≤0.03 wt %; Cr: 13.0-13.1 wt %; Ni: 6.9-7.0 wt %; Co: 5.5-5.6 wt %; Mo: 3.4-3.5 wt %; Ti: 1.9-2.0 wt %; Si: ≤0.1 wt %; Mn: ≤0.1 wt %; P: ≤0.01 wt %; S: ≤0.01 wt %; and Fe: balance.

In yet another embodiment, the disclosed maraging stainless steel has the following nominal composition: C: ≤0.03 wt %; Cr: 13.0-13.1 wt %; Ni: 6.9-7.0 wt %; Co: 5.5-5.6 wt %; Mo: 3.4-3.5 wt %; Ti: 2.1-2.2 wt %; Si: ≤0.1 wt %; Mn: ≤0.1 wt %; P: ≤0.01 wt %; S: ≤0.01 wt %; and Fe: balance.

The disclosed heat processing process for the disclosed maraging stainless steel may include steps of (1) forging in austenite phase region, with a forging ratio of 6-9, and air cooling to room temperature after forging and (2) hot-rolling after forging, with a starting temperature of 1150-1250° C., and a finishing temperature of at least 900° C., and air cooling after hot-rolling.

The disclosed heat treatment process for the disclosed maraging stainless steel may include steps of (1) solution treatment at 1050-1150° C. for 1-2 h, and then air cooling to room temperature; (2) after the solution treatment, cryogenic treatment in liquid nitrogen (−196° C.) for at least 5 h; and (3) after the cryogenic treatment, aging treatment at 450-520° C. for 30 min to 16 h, followed by air cooling.

Other embodiments of the disclosed maraging stainless steel and associated methods will become apparent from the following detailed description, the accompanying drawings and the appended claims.

DETAILED DESCRIPTION

Figure 1A:
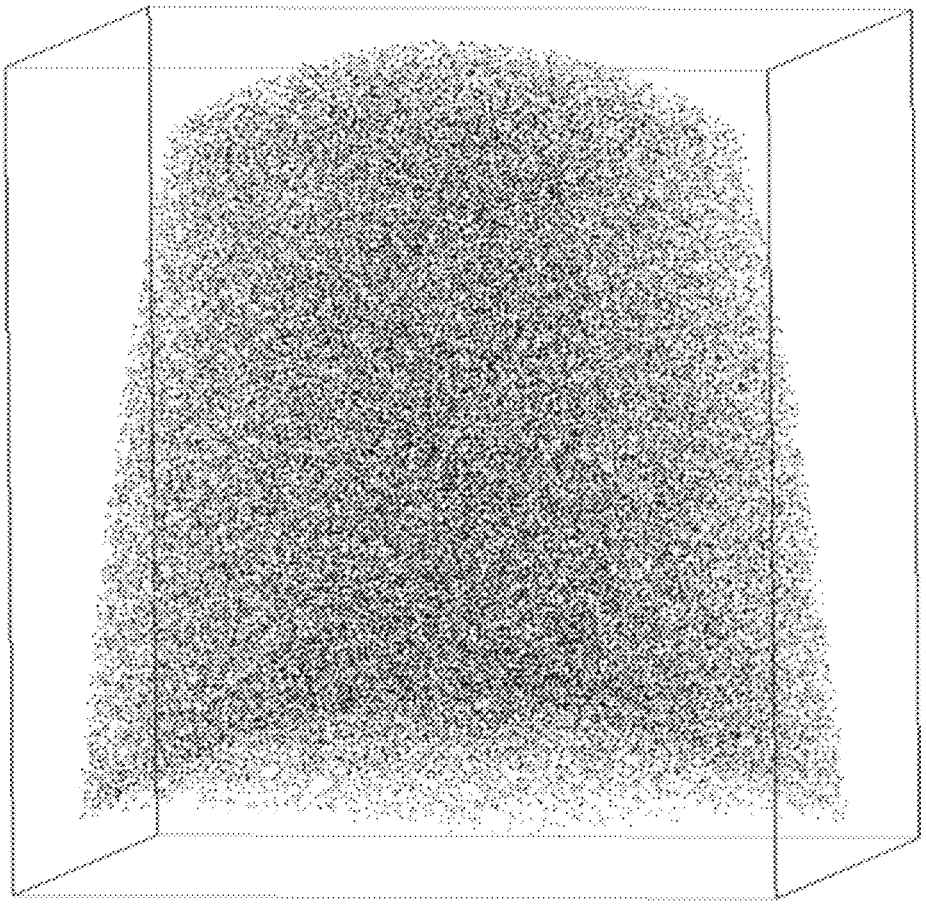
FIGS. 1A and 1B depict the Cr atomic distribution of a maraging stainless steel with Co content of 2.0 wt % (FIG. 1A) and Co content of 12.0 wt % (FIG. 1B).

Disclosed is a maraging stainless steel with both high strength and toughness, and good corrosion resistance. The tensile strength of the disclosed maraging stainless steel can exceed 2000 MPa. The element ratio of Cr, Ni, Mo and Ti is precisely adjusted to get a full maetensitic structure and to maximally guarantee the strength, toughness and corrosion resistance. Moreover, the content of expensive metals, such as Co, is reduced to decrease production cost.

In one embodiment, the disclosed maraging stainless steel has the following nominal composition: carbon (C): ≤0.03 wt %; chromium (Cr): 13.0-14.0 wt %; nickel (Ni): 5.5-7.0 wt %; cobalt (Co): 5.5-7.5 wt %; molybdenum (Mo): 3.0-5.0 wt %; titanium (Ti): 1.9-2.5 wt %; silicon (Si): ≤0.1 wt %; manganese (Mn): ≤0.1 wt %; phosphorus (P): ≤0.01 wt %; sulfur (S): ≤0.01 wt %; and iron (Fe): balance.

In another embodiment, the disclosed maraging stainless steel has the following nominal composition: C: ≤0.03 wt %; Cr: 13.0-13.1 wt %; Ni: 6.9-7.0 wt %; Co: 5.5-5.6 wt %; Mo: 3.4-3.5 wt %; Ti: 1.9-2.0 wt %; Si: ≤0.1 wt %; Mn: ≤0.1 wt %; P: ≤0.01 wt %; S: ≤0.01 wt %; and Fe: balance.

In yet another embodiment, the disclosed maraging stainless steel has the following nominal composition: C: ≤0.03 wt %; Cr: 13.0-13.1 wt %; Ni: 6.9-7.0 wt %; Co: 5.5-5.6 wt %; Mo: 3.4-3.5 wt %; Ti: 2.1-2.2 wt %; Si: ≤0.1 wt %; Mn: ≤0.1 wt %; P: ≤0.01 wt %; S: ≤0.01 wt %; and Fe: balance.

Without being limited to any particularly theory, it is believed that C is an impurity element in the disclosed maraging stainless steel, and excessive C content is prone to reacting with Ti to form Ti(C,N) type carbonitride, which severely deteriorates the toughness and corrosion resistance. Therefore, the C content is controlled at 0.03 wt % or less.

Without being limited to any particularly theory, it is believed that the presence of Ni in the disclosed maraging stainless steel is significant because Ni reacts with Mo and Ti to form main strengthening phase Ni3(Ti, Mo). Ni in the matrix improves steel toughness, and ensures the martensitic transformation. However, excessive Ni may lead to the formation of residual austenite, which may deteriorate the steel strength. Therefore, the content of Ni is controlled at 5.5-7.0 wt %.

Without being limited to any particularly theory, it is believed that the presence of Cr in the disclosed maraging stainless steel is also significant. In order to achieve "stainless" properties, the Cr content in the steel must be 13 wt % or more. However, the full martensitic microstructure cannot be obtained by normal heat treatment in the case of steel containing excessive Cr content, which limits steel strength, toughness and corrosion resistance. Therefore, the Cr content is controlled at 13.0-14.0 wt %.

Without being limited to any particularly theory, it is believed that Mo forms a strengthening phase Ni3(Ti, Mo) after aging. In addition, Mo and Cr in the matrix will synergistically improve the corrosion resistance. The main effect of Ti is to strengthen the matrix by forming intermetallic compounds like Ni3Ti and Ni3(Ti, Mo). The strengthening effect of Ti is stronger than that of Mo. In view of the comprehensive consideration of microstructure, strength and toughness, the contents of Mo and Ti are controlled at Mo: 3.0-5.0 wt % and Ti: 1.9-2.5 wt %.

Figure 1B:
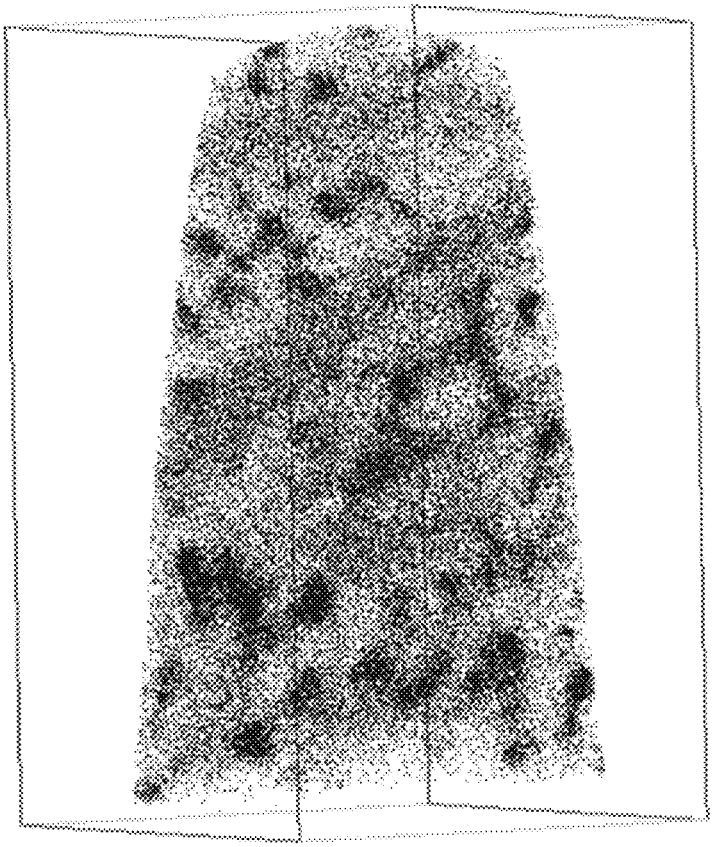

Without being limited to any particularly theory, it is believed that the presence of Co in the disclosed maraging stainless steel is also significant. Co increases the martensitic transformation starting temperature (Ms). Meanwhile, Co facilitates the precipitation of strengthening phase Ni3 (Ti, Mo), thereby strengthening the matrix. However, it was discovered that the increase in Co content can severely deteriorate the steel corrosion resistance. As demonstrated by the three-dimensional atom probe (APT) results shown in FIGS. 1A and 1B, the Co addition promotes Cr segregation, thereby reducing the steel corrosion resistance. Moreover, Co is a precious metal element and increases steel cost. As such, the content of Co is controlled at 5.5-7.5 wt %.

In order to ensure the strength and toughness of the disclosed maraging stainless steel, impurity elements may be controlled as follows: Si: ≤0.1 wt %; Mn: ≤0.1 wt %; P: ≤0.01 wt %; and S: ≤0.01 wt %.

When compared with traditional high strength stainless steels, the disclosed maraging stainless steel possesses both high strength/toughness and high corrosion resistance. The above specific advantage is: the tensile strength of the disclosed maraging stainless steel reaches 2000 MPa or more, comparable to Custom475, which performs a highest strength level in Table 2. The ductility is significantly superior to Custom475, and the elongation reaches 8% or more. Compared with the common high strength stainless steels in Table 3, the disclosed maraging stainless steel possesses the highest strength level, meanwhile the pitting potential reaches 0.020 V, and the pitting resistance is comparable to PH13-8Mo precipitation hardening stainless steel. It can be seen that the disclosed maraging stainless steel shows excellent comprehensive performance as comparted to the high strength stainless steels listed in Table 3.

TABLE 3

Strength and corrosion resistance of ultra-high strength stainless steels

| Trademark | Heat treatment process | Tensile strength, MPa | Pitting potential, V |
|---|---|---|---|
| PH17-4 | 1040° C. for 1 h + oil cooling + 480° C. for 4 h | 1310 | −0.060 |
| PH15-5 | 1040° C. for 1 h + oil cooling + 480° C. for 4 h | 1325 | −0.027 |
| Steel A | 1100° C. for 1 h + water cooling + 510° C. for 8 h | 1550 | 0.330 |
| PH13-8Mo | 925° C. for 1 h + oil cooling + 535° C. for 4 h | 1550 | 0.054 |
| Custom465 | 900° C. for 1 h + (−196)° C. for 8 h + 510° C. for 4 h | 1765 | −0.15 |
| The steel of the present invention | 1050° C. for 1 h + (−196)° C. + 480° C. for 10 h | 2021 | 0.020 |

The disclosed maraging stainless steel may be manufactured using various techniques without departing from the scope of the present disclosure.

In one particular embodiment, the disclosed maraging stainless steel may be manufactured using high-purity metals as the source of the alloying elements. Once the desired composition is obtained, the high-purity metals may be smelted in a vacuum induction furnace and casted in a furnace. Riser excision and surface scalping for the casting ingots may be performed, and then a thermal processing step may be initiated. Heat processing and heat treatment may play a significant role in the final microstructure and steel properties.

In one implementation, heat processing may include: (1) forging in austenite single-phase region, with a forging ratio of 6-9, and air cooling to room temperature after forging; and (2) hot-rolling after forging, with starting temperature of 1150-1250° C., and finishing temperature ≥900° C. The total accumulative rolling reduction for hot-rolling is 80% or more.

In one implementation, the heat treatment process may include: (1) solution treatment at 1050-1115° C. for 1-2 h, and then air cooling to room temperature; (2) cryogenic treatment in liquid nitrogen (−196° C.) for 5 h or more; and (3) aging treatment at 450-520° C. for 30 min to 16 h, followed by air cooling.

In another implementation, the heat treatment process may include: (1) solution treatment at 1100° C. for 1.5 h, and then air cooling to room temperature; (2) cryogenic treatment in liquid nitrogen (−196° C.) for 10 h; and (3) aging treatment at 480° C. for 10 h, followed air cooling.

EXAMPLES

Example 1

After batching and mixing according to the following nominal components (in mass): C: 0.02%, Cr: 13.0%, Ni: 4.5%, Co: 6.0%, Mo: 4.5%, Ti: 2.0%, Si: 0.1%, Mn: 0.1%, P: 0.01%, S: 0.01% and Fe: balance, they were melted in a vacuum induction melting furnace and casted.

Hot processing and thermal treatment were performed according to the following processes: (1) forging in austenite single-phase region, with a forging ratio of 8, and then air cooling to room temperature after forging; (2) hot-rolling after forging, with starting temperature of 1200° C., and a finishing temperature of 900° C. The total accumulative rolling reduction for hot-rolling was 80%; and (3) heat treatment: solution treatment at 1100° C. for 1.5 h, and air cooling to room temperature, cryogenic treatment for 6 h at −196° C., and aging treatment for 12 h at 480° C., and then air cooling to room temperature.

The resulting material was machined into a specimen of 10×10×5 $mm^3$ after heat treatment, microstructure observation was then performed.

Figure 2:
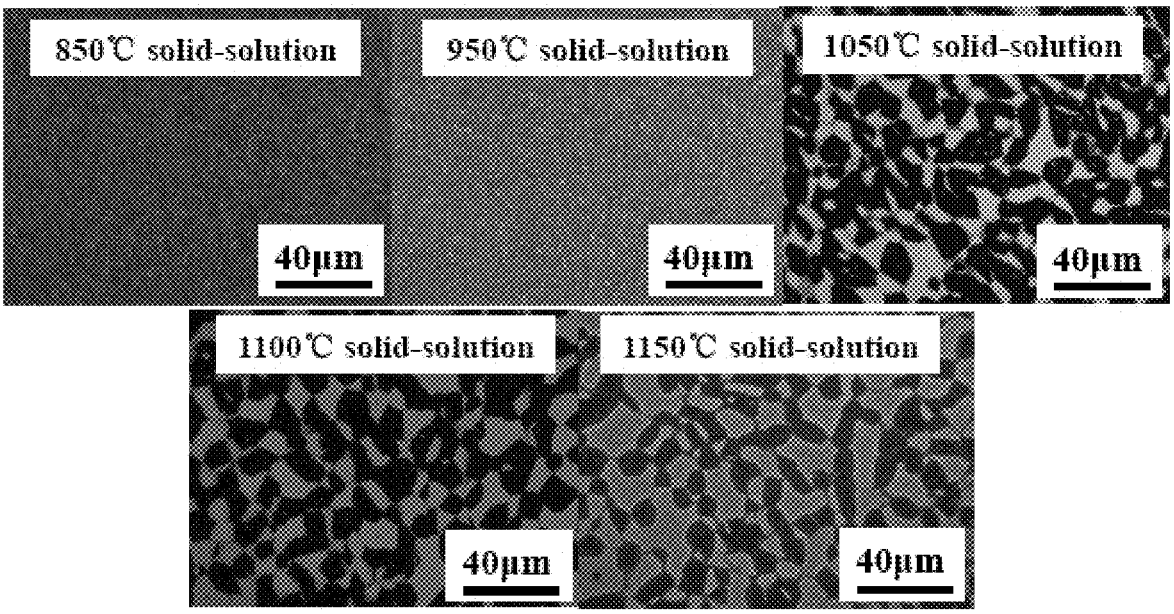
FIG. 2 depicts the optical microstructures of maraging stainless steel with the nominal composition described in Example 1 after the following heat treatment processes: solution treatment for 1.5 h at different temperatures, cryogenic treatment (−196° C.) for 6 h and aging for 10 h at 500° C.

FIG. 2 indicates fully martensitic microstructure could not be obtained for such composition through the improvement of heat treatment. The Ni content in this example is lower than the required range of the present disclosure, which indicates that full martensite microstructure could not be obtained when the Ni content is 4.5 wt % or less.

Example 2

Based on Example 1, the contents of partial alloy elements are adjusted. The Cr/Ni equivalent ratio, the type and the amount of precipitated phase are changed, so as to achieve mechanical properties superior to Example 1.

After batching and mixing according to the following nominal compositions (in mass): C: 0.015%, Cr: 13%, Ni: 7%, Co: 6.0%, Mo: 4.5%, Ti: 2.7%, Si: 0.1%, Mn: 0.1%, P: 0.01%, S: 0.01%, and Fe: balance, they were melted in a vacuum induction melting furnace and casted. Heat processing and thermal treatment were performed according to the process conditions described in Example 1.

Figure 3:
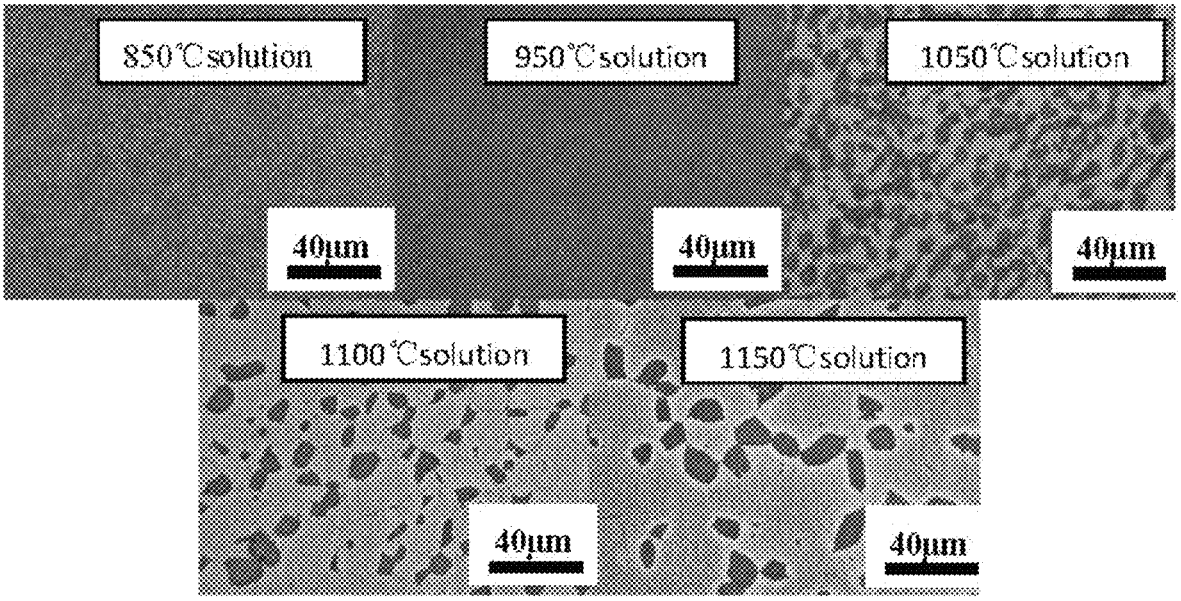
FIG. 3 depicts the optical microstructures of maraging stainless steel with the nominal composition described in Example 2 after the following heat treatment processes: solution treatment for 1.5 h at different temperatures, cryogenic treatment (−196° C.) for 6 h and aging for 10 h at 500° C.

The content of Ti in this example exceeds the required range of the present disclosure. The metallographic microstructure shown in FIG. 3 indicated that the maraging stainless steel with such an alloy composition does not meet requirements. Much precipitates are observed distributed along grain boundary. Further research demonstrates that it is a Ti-rich phase, and the Ti-rich phase will significantly deteriorate the toughness. The content of Ti should be controlled to 1.9-2.5 wt %.

Example 3

Based on the experiences of Examples 1 and 2, the contents of partial alloy elements are further adjusted to obtain required structure (fully martensite). The precipitates are optimized to obtain the novel maraging stainless steel whose mechanical properties are superior to Examples 1 and 2.

After batching and mixing according to the following nominal components (wt %): C: 0.015%, Cr: 13.0%, Ni: 7.0%, Co: 6.0%, Mo: 4.5%, Ti: 2.1%, Si: 0.1%, Mn: 0.1%, P: 0.01%, S: 0.01%, and Fe: balance, they were melted in a vacuum induction melting furnace and casted. Heat processing and thermal treatment were performed for casting ingot according to the process conditions described in Example 1.

Figure 4A:
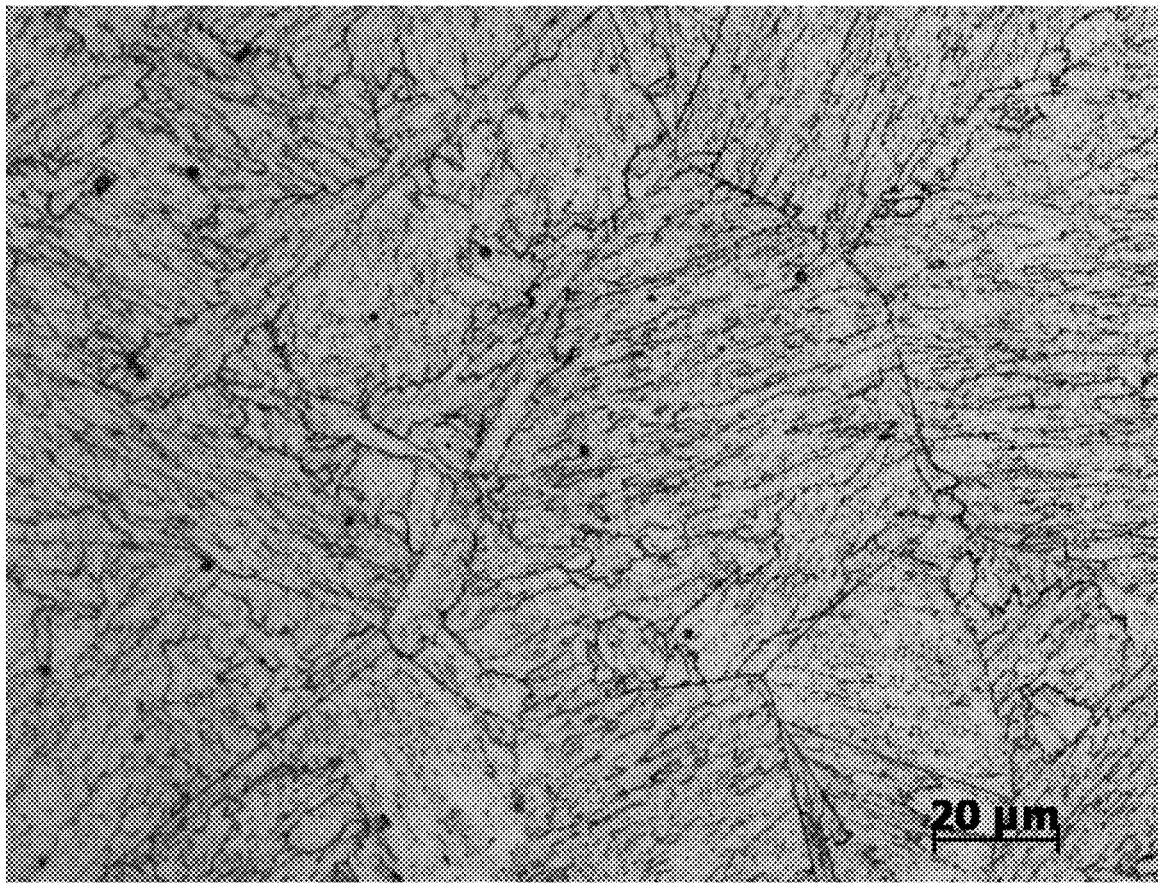
FIGS. 4A and 4B depict the optical microstructure (FIG. 4A) and age hardening curves (FIG. 4B) of maraging stainless steel with the nominal composition described in Example 3 after the following heat treatment processes: solution treatment for 1.5 h at 1050° C., cryogenic treatment (−196° C.) for 6 h and aging for 0.5 to 16 h at 460/480/500° C.
Figure 4B:
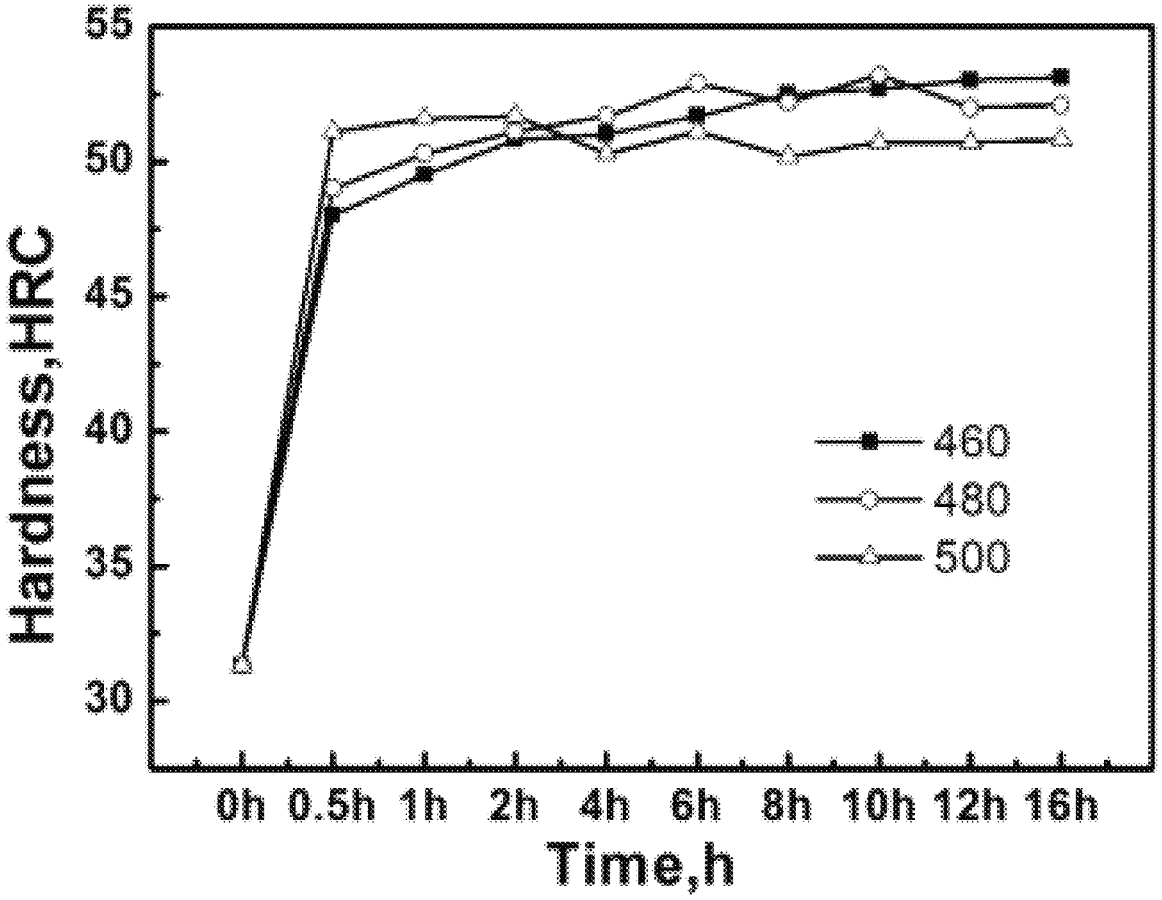

The metallographic organization after heat treatment is shown in FIG. 4A, an eligible fully martensitic organization was successfully obtained via the adjustment of contents of the alloy elements. Age hardening curves of the steel in the present invention at different aging temperatures was shown in FIG. 4B. The resulting material was machined into specimen after heat treatment, the tensile properties thereof with different aging treatments were tested. The test results of tensile mechanical properties were listed in Table 4.

TABLE 4

Test results of tensile mechanical properties in Example 3

| Aging process | Tensile strength, MPa | Yield strength, MPa | Elongation, % | Reduction of area, % |
|---|---|---|---|---|
| 480° C. for 8 h | 2021 | 1759 | 9.0 | 42 |
| 480° C. for 10 h | 2032 | 1749 | 7.5 | 39 |
| 480° C. for 12 h | 2004 | 1805 | 8.5 | 40 |

Figure 5:
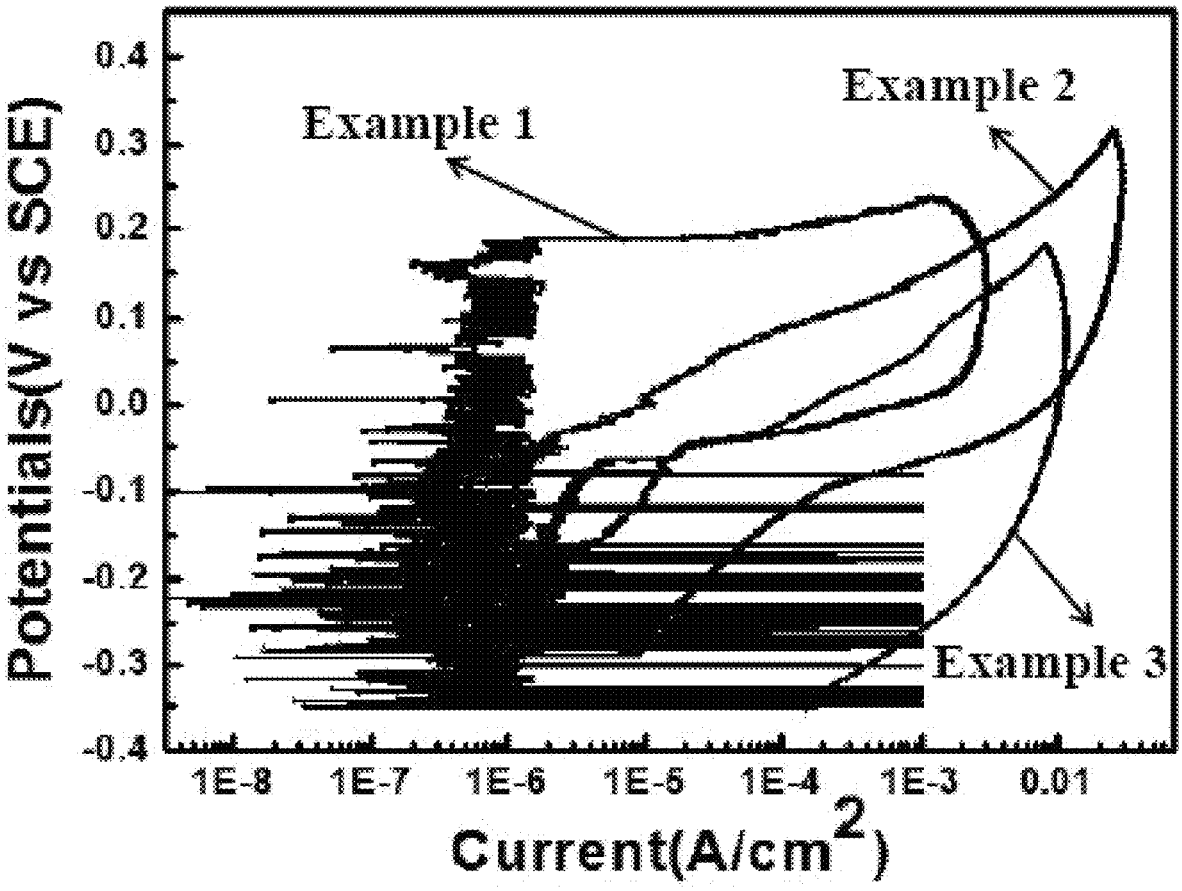
FIG. 5 depicts cyclic potentiodynamic polarization curves measured under the optimal heat treatment for Examples 1, 2 and 3 in 3.5 percent NaCl solution.
Figure 6A:
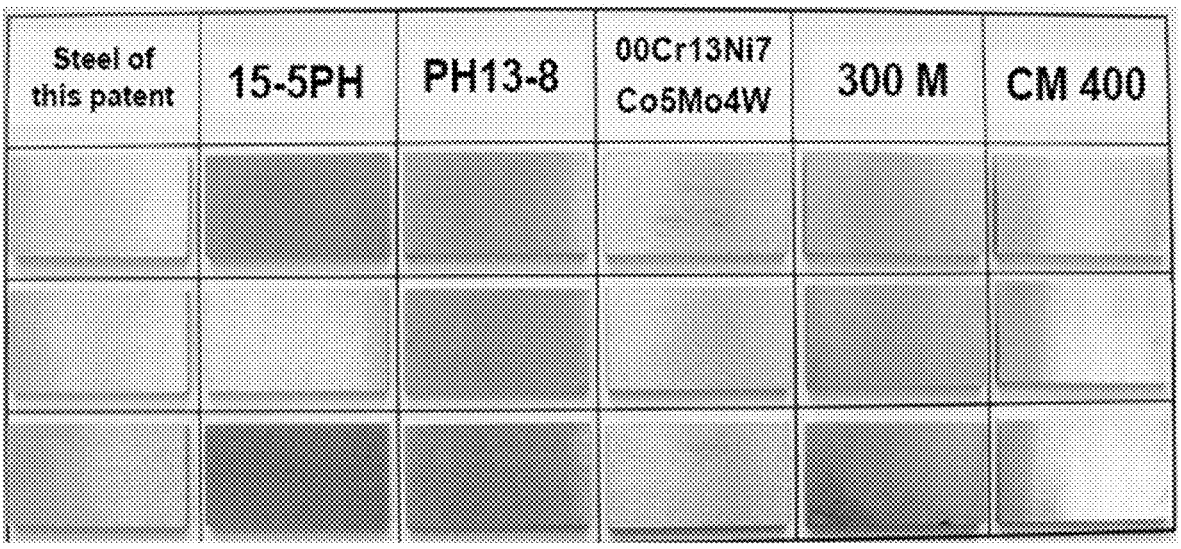
FIGS. 6A and 6B depict the macroscopic morphology of maraging stainless steel with the nominal composition described in Example 3 and comparative materials, both before (FIG. 6A) and after (FIG. 6B) salt-spray corrosion testing.
Figure 6B:
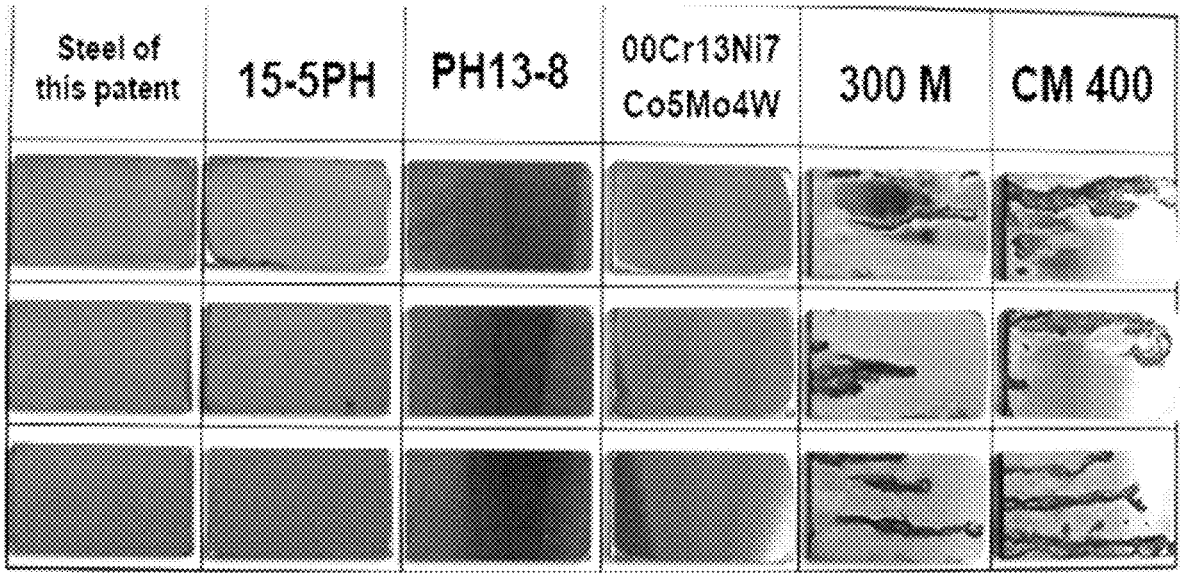

The tensile tests indicate that the steel with such composition has good elongation when the tensile strength reached 2000 MPa or more and fracture toughness is 83 MPa·m1/2. The material with the highest tensile strength was selected and corrosion resistance test thereof was performed. The cyclic potentiodynamic polarization curve of the steel in the present invention is shown in FIG. 5. It can be seen that the experimental materials in Example 1 and Example 2 were both active materials, and corrosion resistances thereof were poor, but the experimental material in Example 3 showed significant passivation behavior, the pitting potential thereof was 0.02 V, and the pitting resistance was superior. In order to further characterize the corrosion resistance of the steel, salt-spray tests were performed for the steel of Example together with the comparative materials. The results of salt-spray tests showed that the corrosion resistance of the steel of Example 3 is comparable to those of the precipitation hardening stainless steels such as 15-5PH, PH13-8Mo, etc., and was significantly superior to those of ultra-high strength steels such as 300 M, CM400, etc.

Example 4

Figure 7:
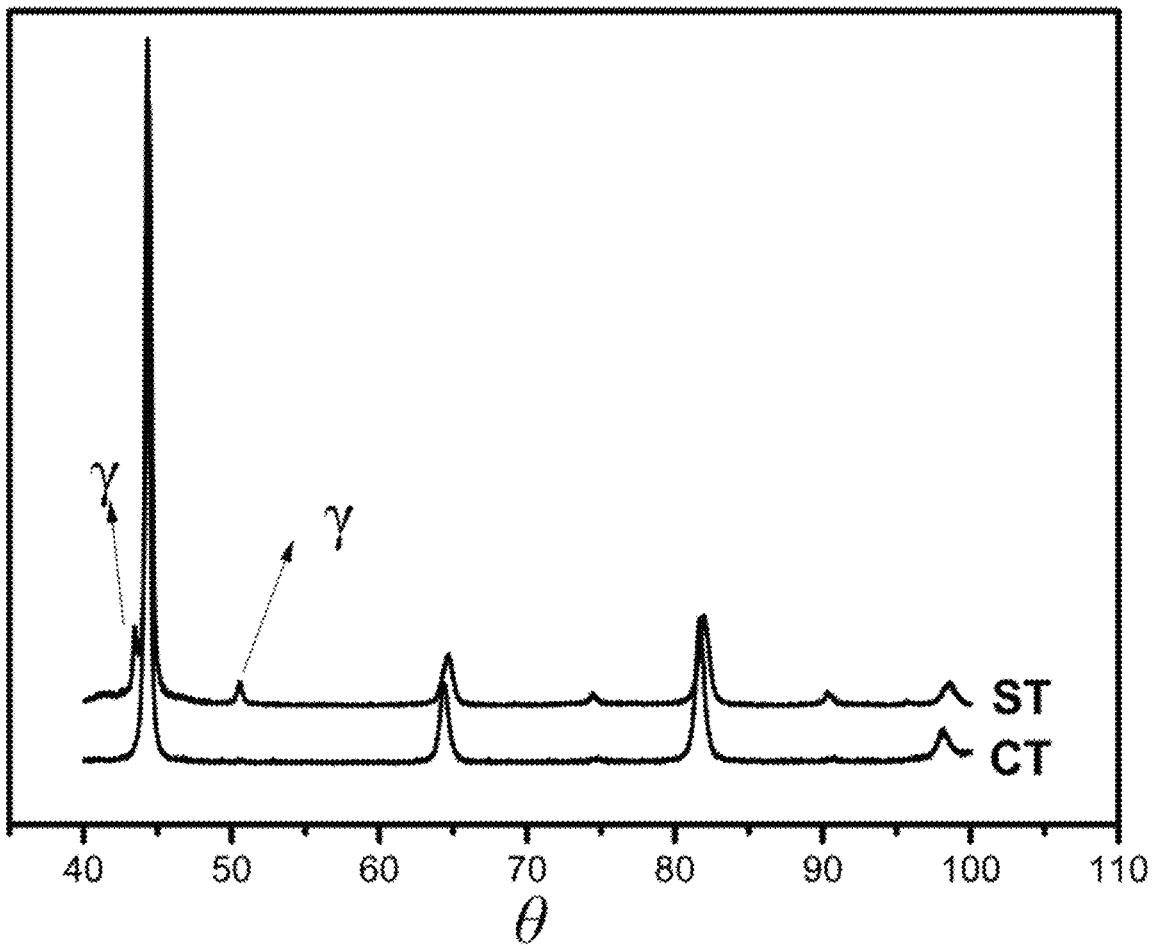
FIG. 7 depicts x-ray diffraction ("XRD") patterns of maraging stainless steel with the nominal composition described in Example 3.

Based on the steel with the nominal composition described in Example 3, the effect of cryogenic treatment on the performance of the steel was characterized. As shown in FIG. 7 (XRD results), much residual austenite has been detected before cryogenic treatment. After cryogenic treatment, the austenite fraction in the matrix was calculated to be less than 2%. In comparison, aging treatment was performed directly after solution treatment without cryogenic treatment and the tensile properties were tested. The test results as follows: $\sigma b$=1905 MPa, $\sigma 0.2$=1650 MPa, $\delta$=14%, $\psi$=45%. The result indicates that the ultimate strength is less than 2000 MPa. It demonstrates that the residual austenite will deteriorate the strength and the cryogenic treatment is advantageous.

As the experimental results indicate, the disclosed steel presents superior strength and toughness and corrosion resistance. In particular, the strength of the steel in Example 3 is higher than 2000 MPa. Also, it possesses significant advantage in toughness and corrosion resistance compared to normal precipitation hardening steel.

Example 5

Different from Example 3, the contents of partial alloying elements were further modestly adjusted to optimize the precipitates and obtain the novel maraging stainless steel with different mechanical properties from Example 3.

After batching and mixing according to the following nominal compositions (in mass): C: 0.01%, Cr: 13.0%, Ni: 6.5%, Co: 7.2%, Mo: 5.0%, Ti: 1.9%, Si: 0.1%, Mn: 0.1%, P: 0.01%, S: 0.01%, Fe: balance, they were melted in a vacuum induction melting furnace. Hot processing and heat treatment were performed for casting ingot according to the process conditions described in Example 1.

The microstructure observation indicated that the maraging stainless steel with such composition presented full martensite structure. The tensile properties were as follow: $\sigma b$=1926 MPa, $\sigma 0.2$=1603 MPa, $\delta$=13%, $\psi$=42%. The strength of this steel is lower than the steel of Example 3. Compared to Example 3, the content of Ti in Example 5 is lower. The fracture toughness was tested after heat treatment, and it reached 86 MPa·m1/2, which demonstrates the significant strengthening effect of Ti in maraging stainless steels.

Example 6

Under the compositional ranges of present disclosure, the contents of partial alloying elements were further modestly adjusted to obtain the novel maraging stainless steel with different mechanical properties and corrosion resistance.

After batching and mixing according to the following nominal composition (wt %): C: 0.015%, Cr: 13.2%, Ni: 5.6%, Co: 6.4%, Mo: 4.5%, Ti: 1.9%, Si: 0.1%, Mn: 0.1%, P: 0.01%, S: 0.01%, Fe: balance, they were melted in a vacuum induction melting furnace. Hot processing and heat treatment were performed for casting ingot according to the process conditions described in Example 1.

The microstructure observation and XRD analysis indicated that the maraging stainless steel of such compositions presented full martensite structure. Further corrosion tests demonstrated that this steel had better corrosion resistance than the steel of Example 3. The tensile tests after different heat treatment processes were also performed. The results are list in Table 5. An optimized heat treatment process applied for Example 6 has been demonstrated to be as follows: solution treatment at 1100° C. for 1.5 h, and air cooling to room temperature, cryogenic treatment at −196° C. for 6 h, and aging treatment at 500° C. for 12 h, and air cooling. After peak aged, the strength of the steel reached 2014 MPa, and the elongation was 9.5%. The fracture toughness was 85 MPa·m1/2.

TABLE 5

Test results of tensile properties in Example 6

| Aging process | Tensile strength, MPa | Yield strength, MPa | Elongation, % | Reduction of area, % |
|---|---|---|---|---|
| 480° C. 10 h | 1983 | 1632 | 9.8 | 40 |
| 500° C. 12 h | 2014 | 1638 | 9.5 | 35 |
| 520° C. 8 h | 1990 | 1680 | 8.5 | 38 |

Example 7

Based on previous experiences, the contents of partial alloying elements were further modestly adjusted to obtain the novel maraging stainless steel with different mechanical properties and corrosion resistance.

After batching and mixing according to the following nominal composition (in mass): C: 0.015%, Cr: 13.1%, Ni: 7.0%, Co: 5.5%, Mo: 3.5%, Ti: 2.2%, Si: 0.1%, Mn: 0.1%, P: 0.01%, S: 0.01%, Fe: balance, they were melted in a vacuum induction melting furnace. Hot processing and heat treatment were performed for casting ingot according to the process conditions described in Example 1.

The microstructure observation and XRD analysis indicated that the maraging stainless steel of such compositions presented full martensite structure. An optimized heat treatment process applied for Example 7 has been demonstrated to be as follows: solution treatment at 1100° C. for 1.5 h, and air cooling to room temperature, cryogenic treatment at −196° C. for 6 h, and aging treatment at 480° C. for 10 h, and air cooling. After peak aged, the strength of the steel reached 2035 MPa, which is comparable to that of Example 3, and the fracture toughness reached 71 MPa·m1/2. Also, the corrosion tests indicated that the steel with this composition performed had corrosion resistance than Example 3 and Example 6. Therefore, this steel has excellent corrosion resistance and excellent mechanical properties.

Although various embodiments and examples of the disclosed maraging stainless steel have been described, modifications may occur to those skilled in the art upon reading the specification. The present application includes such modifications and is limited only by the scope of the claims.

What is claimed is:

1. A method for heat treatment of a stainless steel comprising:

13 to 14 wt % chromium (Cr);
5.5 to 7.0 wt % nickel (Ni);
5.5 to 7.5 wt % cobalt (Co);
3 to 5 wt % molybdenum (Mo);
1.9 to 2.5 wt % titanium (Ti); and
iron (Fe), the method comprising:

solution treatment of the stainless steel at 1050-1150° C. for 1-2 h;
after the solution treatment, cryogenic treatment of the stainless steel in liquid nitrogen (−196° C.) for at least 5 h; and
after the cryogenic treatment, aging treatment of the stainless steel at 450-520° C. for 30 min to 16 h.

2. The method of claim 1 wherein the solution treatment is performed at 1100° C. for 1.5 h.

3. The method of claim 1 wherein the cryogenic treatment is performed for at least 10 h.

4. The method of claim 1 wherein the aging treatment is performed at 480° C. for 10 h.

5. The method of claim 1 wherein:

the solution treatment is performed at 1100° C. for 1.5 h;
the cryogenic treatment is performed for at least 10 h; and
the aging treatment is performed at 480° C. for 10 h.

6. The method of claim 1 wherein the stainless steel comprises a carbon (C) content of at most 0.03 wt %.

7. The method of claim 1 wherein the stainless steel comprises a silicon (Si) content of at most 0.1 wt %.

8. The method of claim 1 wherein the stainless steel comprises a manganese (Mn) content of at most 0.1 wt %.

9. The method of claim 1 wherein the stainless steel comprises a phosphorus (P) content of at most 0.01 wt %.

10. The method of claim 1 wherein the stainless steel comprises a sulfur (S) content of at most 0.01 wt %.

11. The method of claim 1 wherein the stainless steel comprises:

a carbon (C) content of at most 0.03 wt %;
a silicon (Si) content of at most 0.1 wt %;
a manganese (Mn) content of at most 0.1 wt %;
a phosphorus (P) content of at most 0.01 wt %; and
a sulfur (S) content of at most 0.01 wt %.

12. The method of claim 1 wherein the chromium is present in the stainless steel at 13.0 to 13.1 wt %.

13. The method of claim 1 wherein the nickel is present in the stainless steel at 6.9 to 7.0 wt %.

14. The method of claim 1 wherein the cobalt is present in the stainless steel at 5.5 to 5.6 wt %.

15. The method of claim 1 wherein the molybdenum is present in the stainless steel at 3.4 to 3.5 wt %.

16. The method of claim 1 wherein the titanium is present in the stainless steel at 1.9 to 2.2 wt %.

17. The method of claim 1 wherein:

the chromium is present in the stainless steel at 13.0 to 13.1 wt %;
the nickel is present in the stainless steel at 6.9 to 7.0 wt %;
the cobalt is present in the stainless steel at 5.5 to 5.6 wt %;
the molybdenum is present in the stainless steel at 3.4 to 3.5 wt %; and
the titanium is present in the stainless steel at 1.9 to 2.2 wt %.

18. The method of claim 1 wherein the solution treatment of the stainless steel at 1050-1150° C. for 1-2 his followed by air cooling to room temperature.

19. The method of claim 1 wherein the aging treatment of the stainless steel at 450-520° C. for 30 min to 16 h is followed by air cooling.

20. A method for heat treatment of a stainless steel comprising:

13.0 to 13.1 wt % chromium (Cr);
6.9 to 7.0 wt % nickel (Ni);
5.5 to 5.6 wt % cobalt (Co);
3.4 to 3.5 wt % molybdenum (Mo);
1.9 to 2.2 wt % titanium (Ti);
at most 0.03 wt % carbon (C);
at most 0.1 wt % silicon (Si);
at most 0.1 wt % manganese (Mn);
at most 0.01 wt % phosphorus (P);
at most 0.01 wt % sulfur (S); and
iron (Fe), the method comprising:

solution treatment of the stainless steel at 1050-1150° C. for 1-2 h, and then air cooling to room temperature;
after the solution treatment, cryogenic treatment of the stainless steel in liquid nitrogen (−196° C.) for at least 5 h; and
after the cryogenic treatment, aging treatment of the stainless steel at 450-520° C. for 30 min to 16 h, followed by air cooling.

* * * * *